United States Patent [19]

Micheron

[11] 4,092,494

[45] May 30, 1978

[54] LOUD-SPEAKER ENCLOSURE WITH ELECTRICAL FEED-BACK

[75] Inventor: François Micheron, Paris, France

[73] Assignee: Thomson-CSF, Paris, France

[21] Appl. No.: 845,717

[22] Filed: Oct. 26, 1977

[30] Foreign Application Priority Data

Oct. 29, 1976 France ..... 76 32716

[51] Int. Cl.[2] ..... H04R 1/22; H04R 3/00; H04R 3/02

[52] U.S. Cl. ..... 179/1 F

[58] Field of Search ..... 179/1 F

*Primary Examiner*—George G. Stellar

*Attorney, Agent, or Firm*—Cushman, Darby & Cushman

[57] ABSTRACT

The invention relates to loud-speaker enclosures comprising a sealed box with several loud-speakers. More particularly, the invention relates to a sealed box enclosure comprising an amplifier and in which the loud-speakers form two groups which, connected in series, constitute the first two arms of a bridge circuit. The other two arms of said bridge circuit form a voltage divider. A negative feedback loop is connected to the node of the first two arms while a positive feedback loop is connected to the node of the other two arms.

12 Claims, 6 Drawing Figures

LOUD-SPEAKER ENCLOSURE WITH ELECTRICAL FEED-BACK

This invention relates to loud-speaker enclosures intended for sound reproduction and, more particularly, to sealed enclosures equipped with several loud-speakers of the same type.

It is known that, in order to improve the bass-reproduction, it is of advantage to use a loud-speaker of large size. However to obtain favourable characteristics at high frequencies, it is by contrast necessary to select loud-speakers having lightweight diaphragms and small dimensions. This has resulted in the development of electroacoustic enclosures equipped with several loud-speakers of which the individual characteristics enable all the audible frequencies to be correctly reproduced.

In the case of enclosures equipped with several loud-speakers, a much more economic solution is to limit production to one loud-speaker of small dimensions and electrically to interconnect two or more of these loud-speakers so that the diaphragms vibrate in phase. In the base range, the radiation resistance is thus substantially increased whereas, if the same diaphragms were to vibrate in phase opposition, it would be greatly reduced. In order to prevent the waves emitted by the rear faces of the diaphragms from acting in phase opposition with the waves radiated by the front faces of the diaphragm, the loud-speakers are mounted in a sealed enclosure. The air contained in a sealed enclosure contributes in large measure to the stiffness of the elastic suspensions of the diaphragms which produces a substantial increase in the resonance frequency when the loud-speaker alone is compared with the loud-speaker mounted in the enclosure.

In the case of a two-speaker enclosure, the enclosed air may also act as an inert, weakly compressible medium causing antagonistic movements of the two diaphragms. This mode of operation has a generally lower resonance frequency in the vicinity of which the energy radiated by the loud-speakers is particularly low. The frequency response characteristic of an acoustic enclosure equipped with two loud-speakers which are not completely identical thus shows a hump situated at the resonance frequency of the coincident mode and a trough situated at the resonance frequency of the antagonistic mode. The two irregularities have a harmful effect upon the quality of sound reproduction.

In order to obviate this drawback, the invention uses an electrical amplifier system which compensates the frequency response irregularities without the use of electrical filters or acoustic means which are difficult to adjust.

In accordance with the present invention, there is provided a loud-speaker enclosure with electrical feedback comprising a sealed box equipped with several similar loud-speakers, amplifiers means and a bridge circuit; said loud-speakers being excited by said amplifier means through the medium of said bridge circuit; said amplifier means having first and second branching points at which an incident signal produces output voltage components respectively in phase and in phase opposition; said loud-speakers being arranged into two groups having substantially equal emissive characteristics and being situated respectively in two first arms of said bridge circuit connected in series to the output of said amplifier means; said enclosure further comprising a negative feedback loop connecting the junction point of said first arms to the second of said branching points and a feedback loop connecting the junction point of the two remaining arms of said bridge circuit to the first of said branching points.

For a better understanding of the present invention, and to show how the same may be carried into effect reference will be made to the ensuing description with the accompanying drawings among which:

Figure 1:
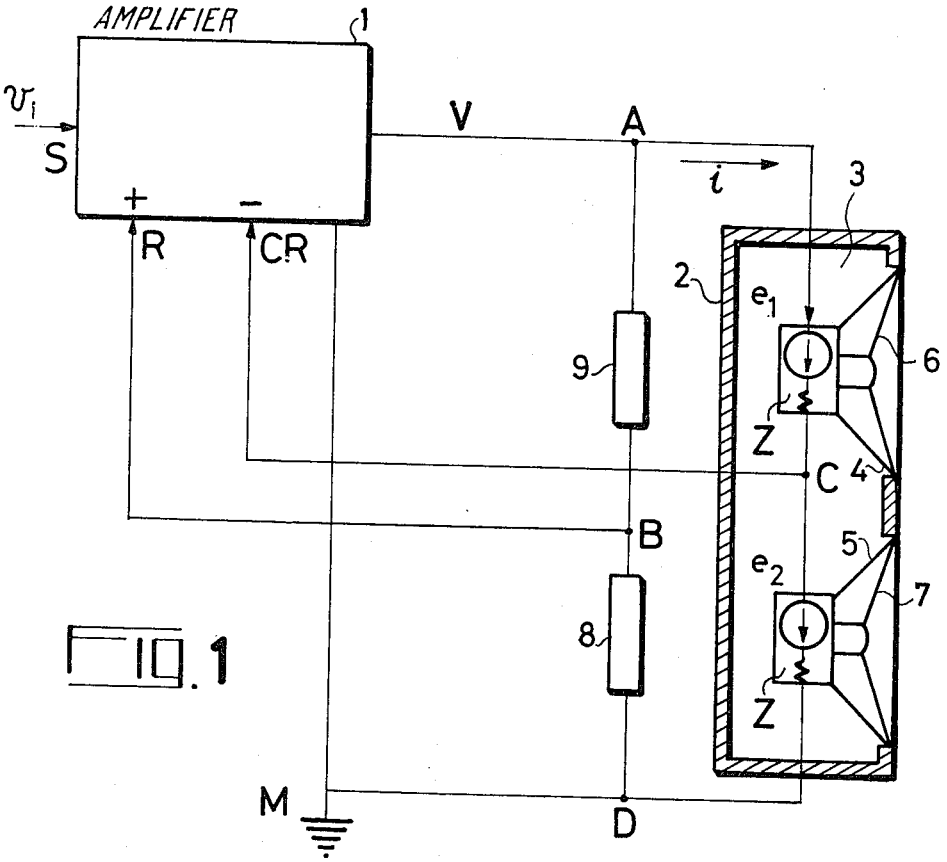
FIG. 1 shows the basic circuit diagram of an electroacoustic enclosure according to the invention.

FIG. 1 shows an electroacoustic enclosure according to the invention. By way of non-limiting example, it comprises two electrodynamic loud-speakers 4 and 5 fixed to the front face of a rigid box 2 in which a certain volume of air is enclosed. This box, designated as being sealed in contrast to a rear open box, may if necessary comprise a small vent. It is of course not necessary for the two loud-speakers to radiate in the same direction and, in addition, it has been found that these two loud-speakers can be replaced by groups of smaller loud-speakers which, suitably connected in series or in parallel, show equivalent emissive properties in the base range.

In FIG. 1, the loud-speakers 4 and 5 are connected in series to the output terminals of the electrical amplifier means 1 which deliver an electrical voltage V under the control of the input voltage $v_i$. The current $i$ flowing through the moving coils of the loud-speakers 4 and 5 is intended to produce forces which simultaneously displace the diaphragms 6 and 7 towards the outside or towards the inside of the box 2. This mode of displacement of the diaphragms 6 and 7 results in compression of the air enclosed in the box 2. The mode in question is the coincident mode to which correspond a resonance pulsation $\omega_R$ and a relatively high radiation resistance. This mode of vibration in phase is the only vibration mode to occur when the two loud-speakers 6 and 7 are strictly identical. In practice, however, two loud-speakers considered to be similar because they are produced in the same way are nevertheless unequal in terms of sensitivity as a result of acceptable tolerances in the magnetic, electrical and mechanical parameters. Accordingly, the true mode of displacement of the diaphrams 6 and 7 can generally be divided into a coincident vibratory mode to which an antagonistic vibratory mode is added. The antagonistic vibratory mode is encouraged by the acoustic coupling of the two diaphragms. In the bass range where the resonance pulsation $\omega_A$ of the angatonistic vibratory mode is situated, there is a considerable reduction in the radiation resistance. Since the frequency $\omega_A$ differs from the frequency $\omega_R$, irregularities dependent upon that difference are readily observed on the frequency response characteristic.

Figure 2:
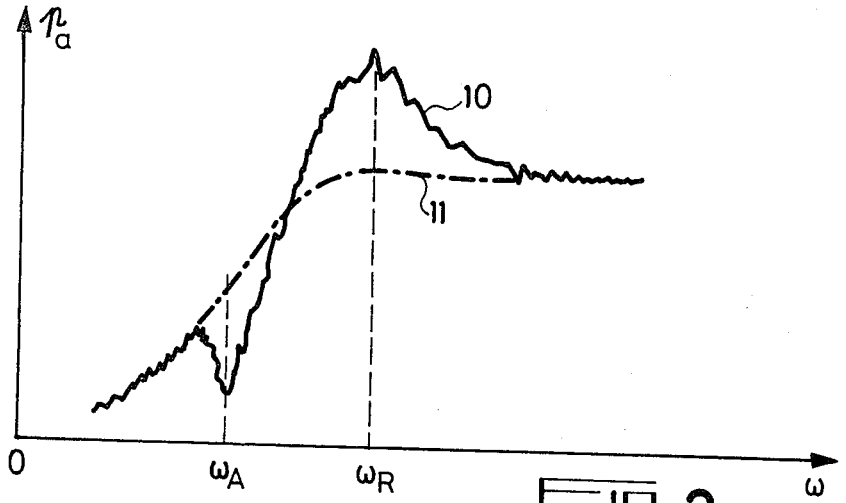
FIG. 2 is an explanatory diagram.

In FIG. 2, the curve 10 represents the variation in the amplitude of the acoustic pressure $p_a$ as a function of the pulsation $\omega$ of the soundwaves radiated. This curve is recorded by keeping constant the amplitude of the alternating current exciting the loud-speakers and in the absence of any compensating means according to the invention. FIG. 2 clearly shows the presence of a resonance peak at the pulsation $\omega_R$ and the presence of a trough at the pulsation $\omega_A$. FIG. 2 illustrates one of the objects of the present invention, namely to modify the response characteristic in accordance with the dash-dot line 11. This result may be obtained by reducing the excitation voltage V in a frequency range centred on the pulsation $\omega_R$ and by increasing this voltage in a frequency range centred on the pulsation $\omega_A$.

According to the invention, these compensations are not obtained with the aid of electrical correcting filters, but instead by using a positive feedback loop and a negative feedback loop between which appears an offset voltage coming from a bridge circuit.

In FIG. 1, the amplifier means 1 are provided with a branching point R to which is connected a positive feedback loop also connected to the node B. The node B is the common point of two arms 8 and 9 which form a voltage divider between the terminals A and D. The terminals A and D are the input terminals of a bridge circuit whilst the terminals B and C are the output terminals of that circuit. The arms AC and CD contain the loud-speakers 4 and 5, in order more clearly to illustrate the electromechanical characteristics, the moving coils have been replaced by the circuit elements Z, $e_1$ and $e_2$. The element Z is the blocked impedance which is measured at the terminals of a loud-speaker when the moving coil is prevented from moving relative to the magnet. The elements $e_1$ and $e_2$ are electromotive force generators and, in the interests of simplicity, it may be noted that the voltages $e_1$ and $e_2$ are respectively proportional to the speeds of movement of the diaphragms 6 and 7. It stands to reason that the ratios $e_{1/i}$ and $e_{2/i}$ represent the impedances of movement which show significant variations at the resonance angular frequencies. It will also be noted that the impedances Z show little variation in the bass range of audio frequencies.

The amplifier means 1 are also provided with a branching point CR to which is connected a negative feedback loop also connected to the node C. In practice, the branching points R and CR are selected in such a way that, when an incident signal is applied to them, an output voltage component V is produced, showing a phase shift of, respectively, substantially zero or 180° relative to that incident signal.

If an a.c. voltage $v_i$, of which the angular frequency $\omega$ is remote from the two resonance angular frequencies $\omega_A$ and $\omega_R$, is applied to the input S of the amplifier means 1, the induced voltages $e_1$ and $e_2$ are low. The global gain of the electro-acoustic enclosure varies little in dependance upon the excitation frequency, but depends to a large extent upon the choice of the elements 8 and 9. The elements 8 and 9 may be formed by fixed resistances selected for example in such a way that the positive feedback exceeds the negative feedback.

If the voltage $v_i$ has a pulsation similar to $\omega_A$, the antagonistic mode gives rise to considerable, phase-opposed induced voltages $e_1$ and $e_2$. The negative feedback changes considerably and can be made to approach in absolute value the unaffected positive feedback. This results in an increase in the voltage V which can fill in the trough shown in FIG. 2.

If the voltage $v_i$ has a pulsation similar to $\omega_R$, the coincident mode gives rise to in-phase induced voltages $e_1$ and $e_2$. The negative feedback may therefore change if — the impedances contained in the arms AC and CD being different- they show a tendency to decrease due to the preponderance of the voltages $e_1$ and $e_2$. The result of this arrangement may be that the negative feedback tends to move away, in terms of absolute value, from the positive feedback which remains fixed. Accordingly, there is a reduction in the voltage V which flattens the hump shown in FIG. 2.

Figure 3:
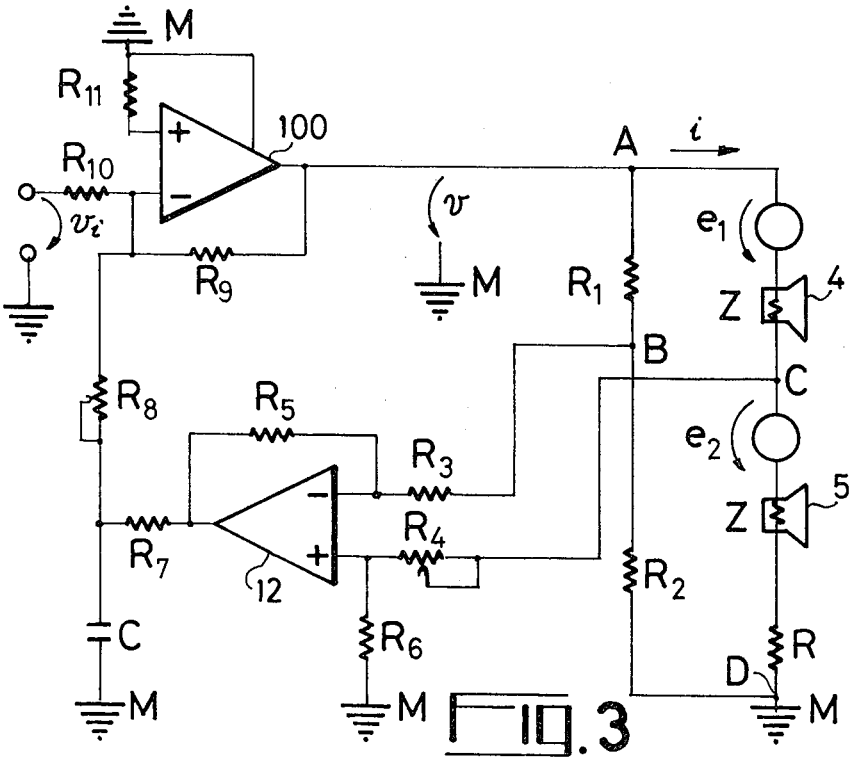
FIG. 3 shows the circuit diagram of one practical embodiment of the invention.

In order to make the preceding explanation more concrete, a complete circuit diagram of an electro-acoustic enclosure is shown by way of non-limiting example in FIG. 3. In this circuit diagram, the same references denote the elements common to FIGS. 1 and 3. It will be noted that a series resistance R has been introduced into the arm CD. The elements 9 and 8 have been replaced by resistances $R_1$ and $R_2$ which define an attenuation factor $\alpha$. The voltage available at the point B is thus equal to $\alpha$.V. The amplifier means comprise a power amplifier 100 of which the non-inverted input is connected to earth M by a resistance $R_{11}$. The input voltage $v_i$ is applied to the inverted input via a resistance $R_{10}$. A negative feedback is applied to the amplifier 100 by means of a resistance $R_9$ selected to fix the gain to the absolute value $k$. A differential amplifier 12 controls the inverted input of the amplifier 100 via a low-pass filter $R_7$ C and a resistance $R_8$. The positive feedback loop starting from the node B is connected to the inverted input of the amplifier 12 by a resistance $R_3$. The negative feedback loop starting from the node C is connected to the non-inverted input of the amplifier 12 by a resistance $R_4$. Resistances $R_5$ and $R_8$ fix the gain of the amplifier 12 and balance the differential circuit.

In the interests of clarity, here are some practical values which give good results with two loud-speakers having a diameter of 13 cm and an impedance of 4 ohms which are mounted in a sealed box having a volume of 20 liters:

$$R_{11} = R_{10} = R_8 = R_5 = R_3 = R_4 = R_6 = 10\ \text{K}\Omega$$

$$R_9 = 470\ \text{k}\Omega;\ R_7 = 5\ \text{k}\Omega;\ R_1 + R_2 = 200\ \Omega$$

$$R = 1\ \Omega;\ C = 2.10^{-7}\ \text{F}.$$

By way of indication, in this specific case, the angular frequency $\omega_A$ corresponds to a resonance frequency of 52 c/s whilst the angular frequency $\omega_R$ corresponds to a resonance frequency of 150 c/s.

An elementary calculation, which need not be explained in detail, leads to the following results:

For the the coincident vibratory mode, $e_1 = e_2$ and the voltage V may be expressed as follows:

$$V = \frac{v_i - \dfrac{R\,e_1}{R + Z_1}}{\alpha + \dfrac{Z}{R + 2Z} - (1 + \dfrac{1}{k})} \qquad \text{(a)}$$

For the antagonistic vibratory mode, $e_1 = -e_2$ and the voltage V may be expressed as follows:

$$V = \frac{v_i - e_1}{\alpha + \dfrac{Z}{R + 2Z} - (1 + \dfrac{1}{k})} \qquad \text{(b)}$$

It can be seen from these two expressions that the feedback loop outweights the negative feedback loop when $$\alpha + \frac{Z}{R + 2Z}$$

is greater than $1 + 1/k$. The expression (a) shows that, at the resonance pulsation, $\omega_R$, the voltage V becomes minimal to an extent which is greater, the larger the value of R in relation to Z.

The expression (b) shows that, at the resonance pulsation $\omega_A$, the voltage V may tend to be maximal or minimal. In effect, the direction in which the voltage V varies depends upon the phase shift between $V_i$ and $e_1$ and the most efficient loud-speaker may be placed either in the arm AC or in the arm CD.

Naturally, there is nothing to prevent the electro-acoustic enclosure from being made to operate in such a way that the negative feedback loop outweighs the positive feedback loop. In this case, the value $$\alpha + \frac{Z}{R + 2Z}$$

must be selected lower than $1 + (1/k)$, resulting in corrections acting in the opposite direction on the frequency response characteristic.

With regard to the unbalance of the arms AC and CD, similar results may be obtained by placing a resistance in parallel with the moving coil of a loud-speaker instead of connecting it in series, as shown in FIG. 3.

The filter $R_7C$ is a low-pass filter which is intended to render the loop inoperative beyond a frequency of the order of 250 c/s. This element $R_7C$ is optional, although it enables the frequency response characteristic to be kept at a constant level in the trebble register.

Figure 4:
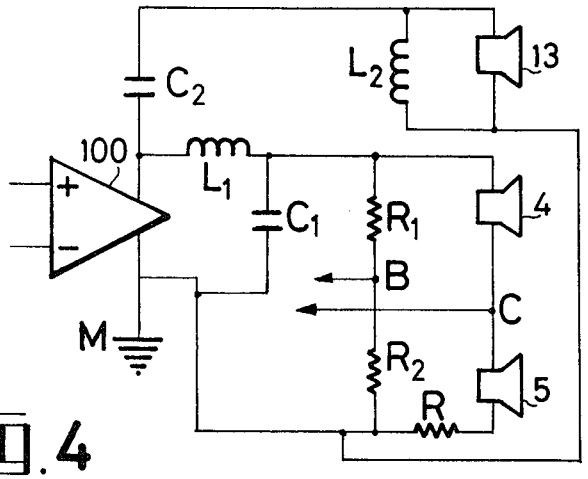
FIG. 4 illustrates one variant.

FIG. 4 is a partial circuit diagram of a modified embodiment of the electro-acoustic enclosure according to the invention. An additional loud-speaker 13 for reproducing high frequencies is connected to the amplifier 100 by a high-pass filter $L_2C_2$. A complementary low-pass filter $L_1C_1$ blocks transmission of the high frequencies to the loud-speakers 4 and 5.

Thus far, it will have been noted that the voltage divider consisting of the arms AB and BD gives an attenuation ratio $\alpha$ which depends neither upon the frequency nor upon the amplitude of the voltage V. The amplitude corrections are solely dependent upon the induced voltages $e_1$ and $e_2$ which characterise the diaphragm movements of the loud-speakers.

Without departing from the scope of the present invention, it is possible for the arrangement to be such that the attenuation ratio $\alpha$ is able to vary with the frequency or amplitude of the excitation signal. With regard to the frequency variation, the resistances $R_1$ and $R_2$ may be replaced by dipoles of the RC, RL or RLC type enabling the frequency response characteristic to be modelled in the same way as it is by convenional sound correction networks.

Figure 5:
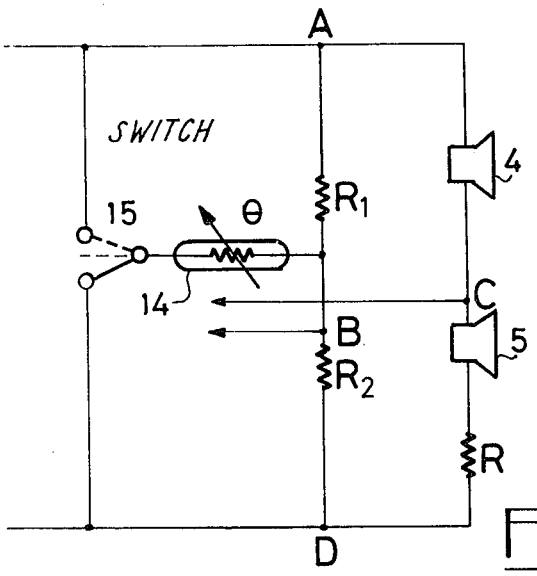
FIG. 5 illustrates another variant.

So far as the amplitude variation is concerned, FIG. 5 shows a partial circuit diagram of another variant of the arrangement shown in FIGS. 1 and 3.

A three-position switch 15 enables a resistance 14 having a high temperature coefficient to be connected to one of the arms AB or BD. When the voltage V applied to the bridge circuit increases in value, the resistance 14 heats up and changes value. The modification of the attenuation ratio $\alpha$ is thus dependent upon the temperature $\theta$ which modifies the gain of the electro-acoustic enclosure.

Figure 6:
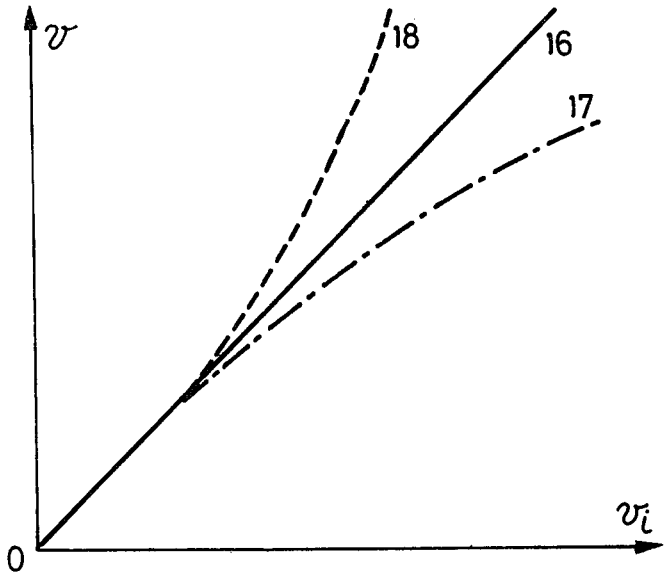
FIG. 6 is an explanatory diagram.

With the circuit shown in FIG. 5, it is possible to obtain a dynamic expansion of the sound, as shown by the curve 18 in FIG. 6. It is also possible to obtain a dynamic compression, as represented by the curve 17. When the switch 15 is in the intermediate position, reproduction is linear, as shown by curve 16.

The resistance 14 may with advantage be formed by a resistance having a negative temperature coefficient and a low thermal inertia, although it is also possible to use an incandescent lamp or any other device which produces the necessary variation in resistance under the influence of the voltage V.

It may be noted that the compression of the dynamics is advantageous in the bass range as a means of obtaining an equalization of the physiological type, because it is known that the auditive characteristics are such that, at a low listening level, the bass sounds have to be strengthened whereas, at higher level, they have to be weakened in order to retain a balanced, natural sound reproduction.

Although the electroacoustic enclosure described above comprises only two loud-speakers mounted in the same sealed box, it is possible to provide a larger number of loud-speakers. For example, four or six loud-speakers may be electrically grouped in twos or threes so as to form two radiating groups having comparable emissive characteristics. In this case, there exists a coincident vibratory mode and at least one antagonistic vibratory mode to which the compensations described above may be applied. It should also be noted that the invention is not limited to the case where the positive feedback outweighs the negative feedback. It is quite possible to select the opposite case with a view to obtaining a compensation of the frequency response characteristic, on the sole condition that, in the established operating mode, measures are taken to avoid the self oscillation which tends to set in if the positive feedback is exactly cancelled by the negative feedback. In the case of the elementary calculation which led to the expressions (a) and (b), it can be seen that the denominator must not become zero, which is achieved when:

$$\alpha + \frac{Z}{R + 2Z} \neq 1 + \frac{1}{k}$$

What I claim is:

1. A loud-speaker enclosure with electrical feedback comprising a sealed box equipped with similar loud-speakers, amplifier means and a bridge circuit; said loud-speakers being excited by said amplifier means through the medium of said bridge circuit; said amplifier means having first and second branching points at which an incident signal produces output voltage components respectively in phase and in phase opposition; said loud-speakers being arranged into two groups having substantially equal emissive characteristics and being situated respectively in two first arms of said bridge circuit connected in series to the output of said amplifier means; said enclosure further comprising a negative feedback loop connecting the junction point of said first arms to the second of said branching points and a feedback loop connecting the junction point of the two remaining arms of said bridge circuit to the first of said branching points.

2. An enclosure as claimed in claim 1, wherein said amplifier means comprise a first differential amplifier of which the output is coupled to the inverted input of a second amplifier; said feedback loop being connected to the inverted input of said first differential amplifier; said negative feedback loop being connected to the non-inverted input of said first differential amplifier; said first arms being connected to the output of said second amplifier.

3. An enclosure as claimed in claim 2, wherein the output of said first differential amplifier is connected to the inverted input of said second amplifier via a low-pass filter.

4. An enclosure as claimed in claim 1, wherein one of said first arms comprise a resistance connected to one of said groups of loud-speakers for causing unbalance between said groups.

5. An enclosure as claimed in claim 4, wherein said resistance is connected in series with said group of loud-speakers.

6. An enclosure as claimed in claim 1, wherein said remaining arms are provided with resistances producing a fixed attenuation factor.

7. An enclosure as claimed in claim 1, wherein said remaining arms are provided with electrical means for obtaining an attenuation factor which is variable in dependence upon the excitation voltage applied to their terminals.

8. An enclosure as claimed in claim 1, wherein said remaining arms are formed by impedances enabling an attenuation factor which is frequency dependent; said attenuation factor varying in accordance with the frequency of the excitation voltage applied across said remaining arms.

9. An enclosure as claimed in claim 1, wherein the effect of said feedback loop is preponderant relative to that of said negative feedback loop.

10. An enclosure as claimed in claim 1, wherein the effect of said negative feedback loop is preponderant in relation to that of said feedback loop.

11. An enclosure as claimed in claim 1, wherein each of said groups of loud-speakers comprises a single loud-speaker.

12. An enclosure as claimed in claim 1, wherein the connection between the output of said amplifier means and said loud-speakers is established by a low-pass filter; an additional loud-speaker being connected via a high-pass filter to the output of said amplifier means.

* * * * *